US005173974A

United States Patent [19]

Proano et al.

[11] Patent Number: 5,173,974

[45] Date of Patent: Dec. 29, 1992

[54] CONVERTIBLE FURNITURE

[76] Inventors: Lou Proano; Rene D. Proano, both of 1648 Channelside Trail, Baldwinsville, N.Y. 13027

[21] Appl. No.: 890,101

[22] Filed: May 29, 1992

[51] Int. Cl.[5] ..... A47D 7/01; A47D 7/02; A47D 7/03

[52] U.S. Cl. ..... 5/93.2; 5/2.1; 5/53.1; 5/285; 5/907

[58] Field of Search ..... 5/93.2, 2.1, 93.1, 53.1, 5/907, 280, 285

[56] References Cited

U.S. PATENT DOCUMENTS

| | | | |
|---|---|---|---|
| 1,193,272 | 8/1916 | Laforest . | |
| 2,223,955 | 12/1940 | Greenbaum . | |
| 3,821,822 | 7/1974 | Borreggine | 5/93.1 |
| 4,361,919 | 12/1982 | Hull | 5/2.1 |
| 4,525,883 | 7/1985 | Necowitz | 5/2.1 |
| 5,038,427 | 8/1991 | Golden | 5/93.2 |
| 5,077,846 | 1/1992 | Wheeler, III et al. | 5/93.2 |

FOREIGN PATENT DOCUMENTS

| | | | |
|---|---|---|---|
| 0356277 | 2/1990 | France | 5/93.2 |

*Primary Examiner*—Alexander Grosz
*Attorney, Agent, or Firm*—Richard C. Litman

[57] ABSTRACT

An article of furniture which is convertible to form a crib, a youth bed, or an adult bed. The crib is produced through the interconnection of a rear panel, a right side panel, a left side panel, a front panel and a mattress support frame. This interconnection of parts provides a substantially rectangular configuration having the mattress support frame horizontally disposed therein. The front panel is comprised of at least a lower section and an upper gate section. The upper access gate section permits a greater access to the confines of the crib. The crib is converted to a youth bed through the removal of the upper gate section and the downward vertical displacement of the mattress support frame. The lower section functions as a "roll bar" purposed to prevent a toddler from rolling off of the edge of a mattress. The roll bar may be eliminated by inverting the lower section. The youth bed is convertible to an adult bed by replacing the mattress support frame and the right and left side panels with independent right and left front upright members, which are respectively attachable to right and left edges of the lower section, and right and left bed rails. The rear panel defines a headboard and the lower section defines a footboard of the adult bed. An optional extension is attachable to the headboard to provide a headboard which is more aesthetically appealing to its user.

12 Claims, 11 Drawing Sheets

52
56
58
54
54

76
74
68
72
70
66
64
62
60

12a
50
48
50
24
26a
44
44
42
46a
44
42
42
18
38
38
36
36
28A
30
34
34
16

CONVERTIBLE FURNITURE

BACKGROUND OF THE INVENTION

1. Field of the Invention

The present invention relates to an article of furniture which may be converted into the form of a crib, a youth bed, or an adult bed.

2. Description of the Prior Art

As infants grow to be toddlers and continue to develop from children into adults, bedding requirements change. Typically, cribs are suitable for infants. Cribs generally are structured such that the mattress is elevated so as to not require the parent or the infant's attendant to bend over a substantial amount to cradle and lift the infant when removing the infant from the crib. More often than not, cribs are provided with a boundary disposed about the entire periphery of the mattress for the purpose of protecting and preventing the infant from rolling off of the mattress onto the floor. To further assist in the handling of the infant or the removal of the infant from a cradle, a portion of the railing is usually mobile. That is, a gate may be provided or a segment of the railing may be movable to offer greater access to the infant and the confines of the crib.

As the infant becomes a toddler, he or she eventually requires substantially more space. The crib is commonly replaced with a suitable bed and, more generally, with a youth bed configured specifically for the needs of a toddler. For example, unlike an infant, a toddler may be able to bed himself or herself. Although this may be true of toddlers, they may still require a security barrier to protect them from rolling off of the edge of the bed. Few youth bed configurations provide this security barrier feature. As the toddler matures on through his or her childhood, there will come a time when the he or she will no longer have need of a security barrier.

Ultimately, the child reaches adulthood and a greater amount of bedding space is desired. Again, as was the case with the crib, the youth bed will need to be replaced. The replacement of a bed is usually compounded with the replacement of an entire ensemble. This could prove to be a very expensive venture over a course of time. A single article of furniture which is configurable to form a crib, a youth bed, or an adult bed would virtually eliminate a scheduled replacement of furniture and, in effect, eliminate a periodic replacement of entire groups of furniture. There are convertible articles of furniture which employ this general concept, however, none can be configured to form either a crib, a youth bed, or an adult bed simply by rearranging existing elements, that is to say, without augmenting additional elements.

U.S. Pat. No. 1,193,272 issued Aug. 1, 1916 to Edward F. Laforest describes a combined bed and crib. The device described can be adjusted to different lengths, providing a crib for an infant and a bed which is adjustable to the size of a child as the child grows.

U.S. Pat. No. 2,223,955 issued Jun. 23, 1929 to Bernard Greenbaum discloses a bed which may be converted from a crib to a regular bed or a day bed. The conversion from one configuration to another is accomplished through the rearrangement or elimination of parts.

U.S. Pat. No. 3,821,822 issued Jul. 2, 1974 to Joseph L. Borreggine describes a combination cradle, crib, and youth bed.

U.S. Pat. No. 4,361,919 issued Dec. 7, 1982 to James R. Hull discloses a convertible child's bed which may be converted from a crib to a standard twin bed through the removal and rearrangement of parts.

U.S. Pat. No. 4,525,883 issued Jul. 2, 1985 to Loretta A. Necowitz teaches of a full size bed convertible to a crib. The full size bed is adaptable to receive railing about its periphery. With the railing disposed about the periphery of the bed, a crib is produced.

U.S. Pat. No. 5,038,427 issued Aug. 13, 1991 to Robert J. Golden discloses a crib which is convertible to a youth bed. The crib has removable sides and a vertically adjustable mattress support structure which permits the crib to be altered through various stages of the child's growth.

U.S. Pat. No. 5,077,846 issued Jan. 7, 1992 to Charles E. Wheeler, III et al. describes a variety of crib structures, one of which includes a bi-folding gate assembly. Any of the variety of cribs may be converted to form a variety of youth sized beds or adult sized beds. The conversion is accomplished through a particular arrangement of parts and more specifically, through the rearrangement, addition, or elimination of parts.

None of the above inventions and patents, taken either singly or in combination, is seen to describe the instant invention as claimed.

SUMMARY OF THE INVENTION

The present invention relates to an article of furniture which may be configured in the form of a crib, a youth bed, or an adult bed. The crib structure is produced through the employment of a rear panel, a right side panel, a left side panel, a front panel and a first mattress support frame. The four panels are interconnected to provide a substantially rectangular configuration. The front panel is comprised of at least two independent sections, a lower section and an upper gate section. The mattress support frame is horizontally disposed within the rectangular configuration. This interconnection of parts yields a crib which has an upwardly extending barrier about the entire periphery of the mattress support frame and a mattress resting thereon. The mattress support frame is vertically adjustable to ensure that a peripheral barrier of a substantial height is provided to meet crib safety standards. The upper access gate section is movable to permit greater access to the confines of the crib and its occupant. To convert the crib to a youth bed, the upper gate section of the front panel is eliminated and the mattress support frame is vertically adjusted downward. The remaining section of the front panel, that is the lower section, when inverted, functions as an optional "roll bar" or a security barrier purposed to prevent a slumbering toddler from rolling off of the edge of the mattress. The security barrier may be eliminated from the youth bed simply by removing, inverting, and reattaching the lower section of the front panel. The youth bed is convertible to an adult bed by removing the mattress support frame and the right and left side panels. These elements may be replaced by independent or separately purchased right and left front corner posts and commonly available conventional right and left bed rails. The new optional independent right and left corner posts are respectively attachable to the right and left edges of the lower section of the front panel. The new conventional right and left bed rails join the rear panel to the front panel. The rear panel defines a headboard and the lower section of the front panel defines a footboard. The transition from one configuration to another is simple. Optional headboard extensions may be employed to present a bed which is more aesthetically appealing to its occupant. The headboard extensions can be reversible. That is, the headboard extension can have one ornamental appearance on a front side and a second ornamental appearance on a rear side to enable a user to employ the extension either front side forward or rear side forward. During the various stages of transition, unused parts may be easily stored, taking up a relatively small amount of space. An entire bedroom group could be so designed that it may be appreciated for an individuals entire lifetime and if fabricated of quality materials, it could last for generations.

Accordingly, it is a principal object of the present invention to provide an article of furniture which may take on a plurality of individual configurations through the mere rearrangement, elimination, or addition of parts.

It is another object of the present invention to provide an article of furniture which may belong to a group or a set and which does not require periodic replacement and, hence, eliminates the periodic replacement of the group or the set.

It is another object of the present invention to provide an article of furniture which employs a rear panel and a front panel which are, in whole or in part, common to each configuration.

It is a further object of the present invention to a front panel which, in whole or in part, facilitates to provide an access gate for a crib, a "roll bar" or a security barrier for a youth bed, a side rail for a youth bed, or an optional footboard for an adult bed.

Still another object of the present invention is to provide a decorative headboard extension which is releasably attachable to the rear panel to enhance the aesthetic appearance of the changing article of furniture throughout its useful life.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
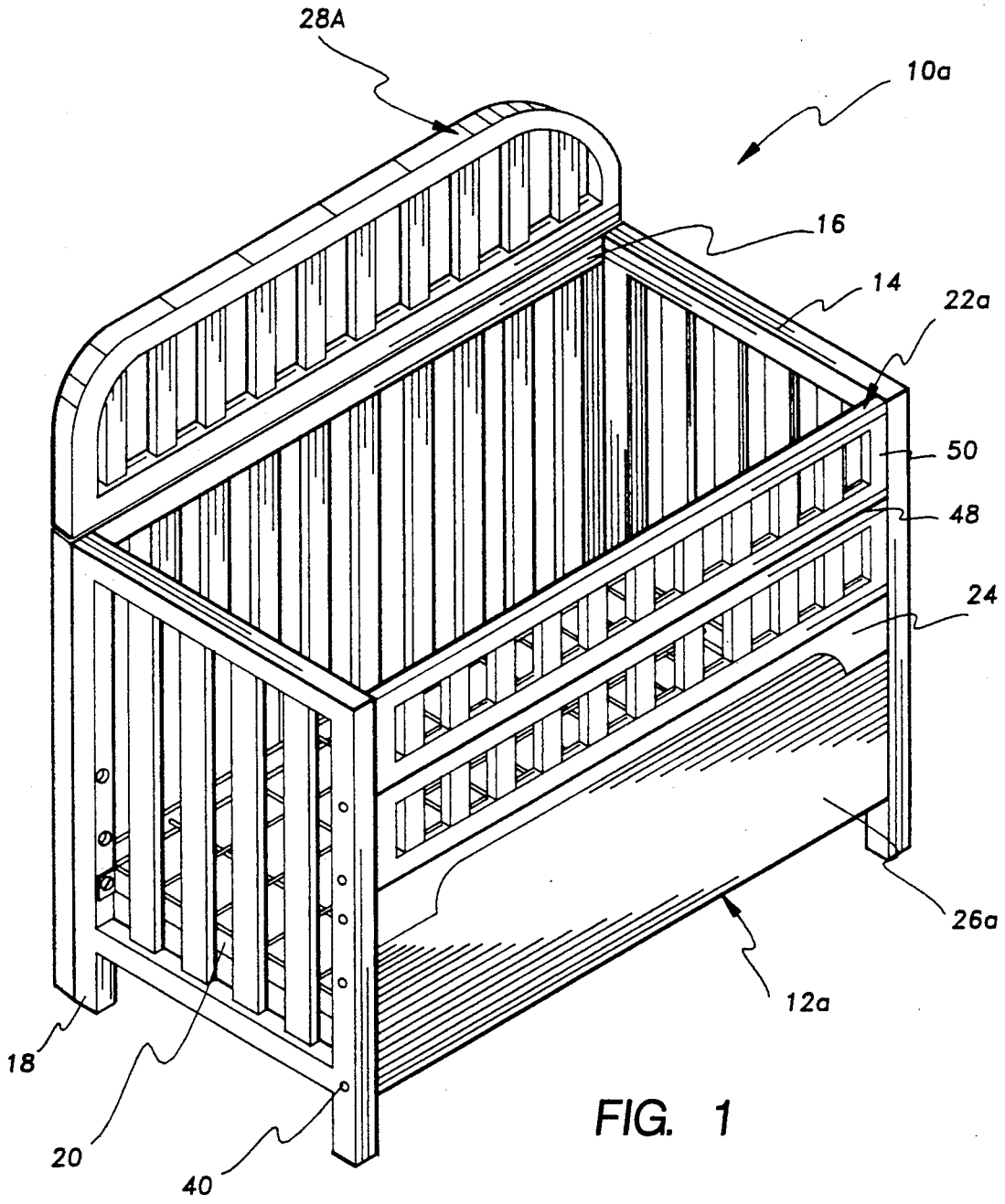
FIG. 1 is an environmental perspective of the present invention shown in a crib configuration.

The present invention is an article of furniture which may be configured to provide a crib 10*a*, 10*b*, a youth bed 80*a*, 80*b*, 80*c*, or an adult bed 90*a*, 90*b*. FIG. 1 illustrates a crib 10*a* configuration comprising five basic elements, a front panel 12*a*, a left side panel 14, a rear panel 16, a right side panel 18, and a mattress support frame 20. The front panel 12*a* includes a upper gate section 22*a*, an intermediate section 24 and a lower section 26*a*. The four panels 12*a*, 14, 16, 18 are interconnected to produce a substantially rectangular structure. The mattress support frame 20 is horizontally disposed within the rectangular frame structure. A supplemental panel, such as a decorative extension, may be attached coextensively to a top edge of the rear panel in a coplanar relation.

Figure 2:
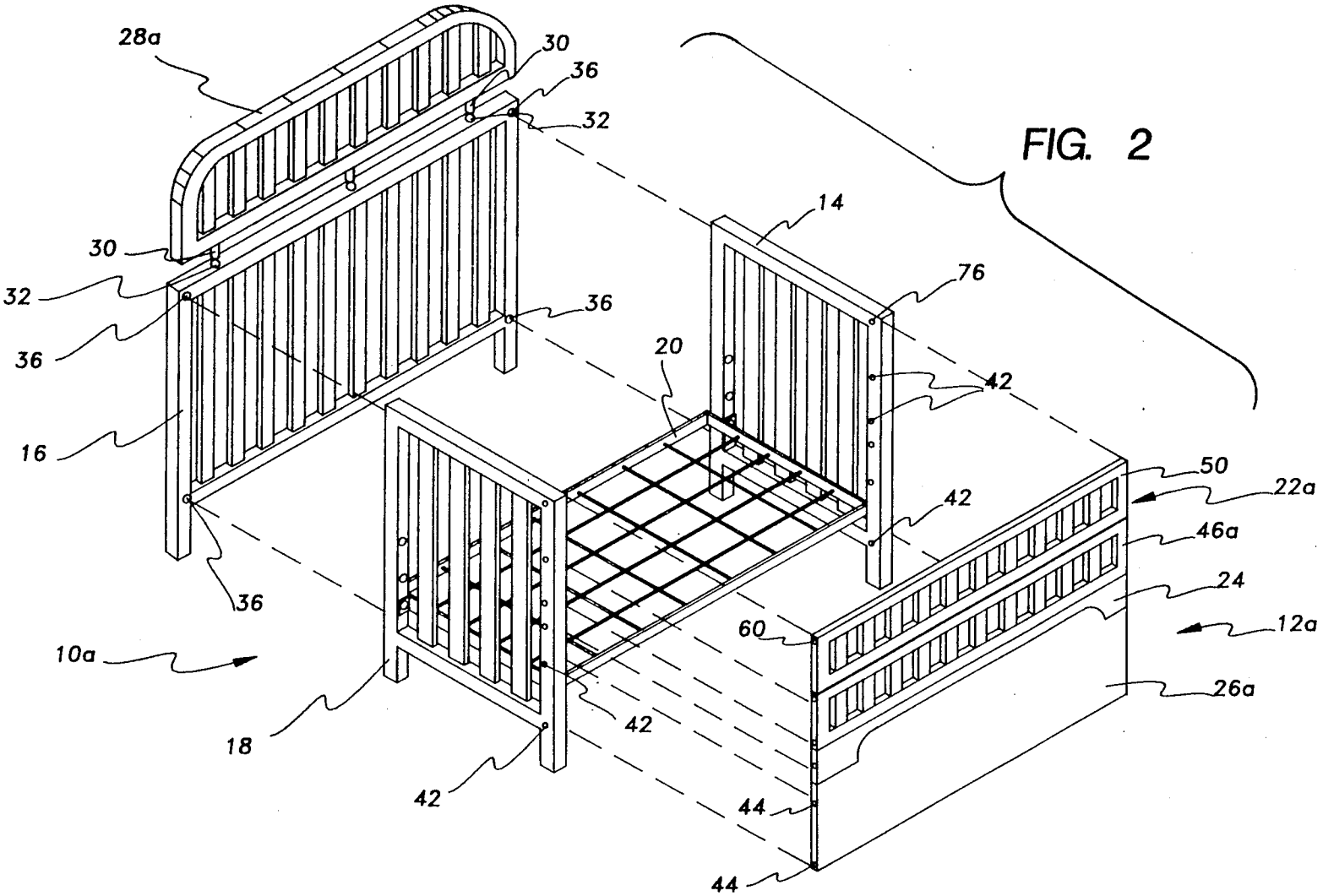
FIG. 2 is a partially exploded perspective view of the present invention shown in a crib configuration.

FIG. 2 shows the front panel 12*a* independent from the rest of the crib structure 10*a*. In this view, it can easily be seen that the front panel 12*a* is formed by the upper gate section 22*a*, the intermediate section 24, and the lower section 24 all arranged coextensively in a co-planar relation. Since each section 22*a*, 24, 26*a* is essentially planar and since each section 22*a*, 24, 26*a* has a substantially vertical attitude, the front panel 12*a* is essentially planar and substantially vertical. Each section 22*a*, 24, 26*a* also includes a top edge, bottom edge, a left edge, and a right edge. The bottom edge of the intermediate section 24 is complementary to the top edge of the lower section 26*a*.

FIG. 2 further shows the rear panel 16 independent of the rest of the crib structure 10*a*. This rear panel 16 is essentially planar and substantially vertical. The rear panel 16 has a top edge, a right upright member, and a left upright member. A supplemental panel 28*a* is shown detached from the rear panel 16 (see the crib 10*b* of FIG. 6). This supplemental panel 28*a* is releasably attachable to the top edge of the rear panel 16 via a hole and peg type fastening means comprising a plurality of dowels 30, each of which mates with a bore 32. The supplementary panel 28*a* may be reversible such that a front side thereof provides one ornamental appearance and a rear side provides a second ornamental appearance. A user to employ the supplementary panel 28*a* either front side forward or rear side forward depending on the ornamental appearance desired.

The front panel 12*a* and the rear panel 16 are structured and dimensioned to define the front and rear sides of the crib 10*a* and are disposed in a spaced apart substantially parallel relationship. The front panel 12*a* and the rear panel 16, in whole or in part, are common to each individual configuration 10*a*, 10*b*, 80*a*, 80*b*, 80*c*, 90*a*, 90*b*.

The left side panel 14 is essentially planar and substantially vertical. This left side panel 14 includes a top edge, a bottom edge, a rear upright member, and a front upright member. The right side panel 18 is essentially planar and substantially vertical as well. This right side panel 18 also includes a top edge, a bottom edge, a rear upright member, and a front upright member. The left side panel 14 and the right side panel 18 are structured and dimensioned to define the left and right sides of the crib 10*a* and are disposed in a spaced apart substantially parallel relationship, just as is the case with the front panel 12*a* and the rear panel 16.

The front panel 12*a* is extendable between the left side panel 14 and the right side panel 18 such that the left edge of the front panel 12*a* is removably attachable to the front upright member of the left side panel 14 and the right edge of the front panel 16 is removably attachable to the front upright member of the right side panel 18. The rear panel 16 is extendable from the left side panel 14 to the right side panel 18 such that the left upright member of the rear panel 16 is removably attachable to the rear upright member of left side panel 14 and the right upright member of the rear panel 16 is removably attachable to the rear upright member of the right side panel 18. The mattress support frame 20 is horizontally disposed between the left side panel 16 and the right side panel 18 and is releasably attachable to the left side panel and the right side panel 18.

Figures 3, 4A, 4B:
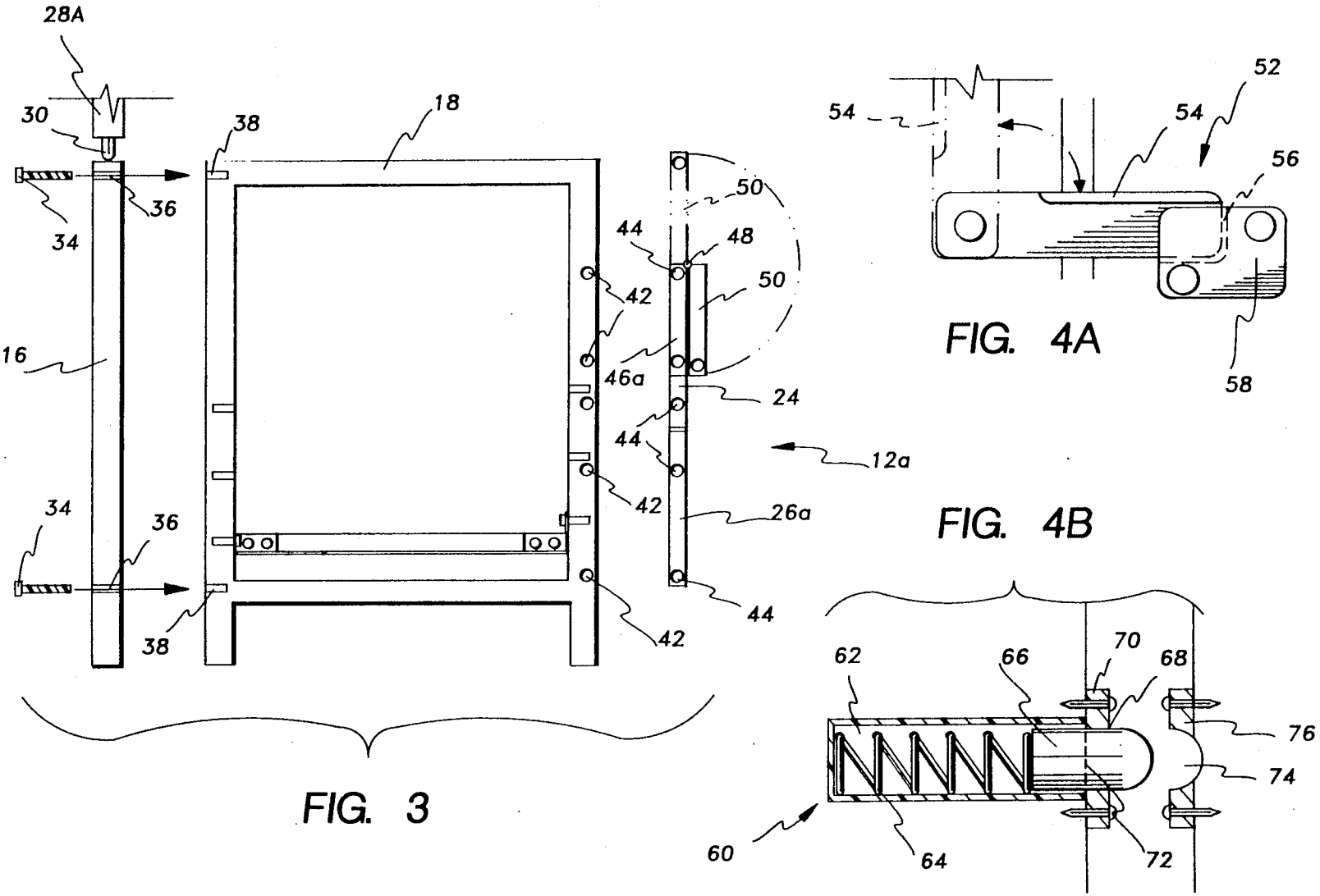
FIG. 3 is a partially exploded side elevational view of the present invention shown in a crib configuration.
FIG. 4A is a view of a pivotal latch assembly.
FIG. 4B is a view of a spring biased detent.

A detail view of the assembly of the crib 10*a* is shown in FIG. 3. This is a view of the right side panel 18, but the left side panel 14 (not shown in this view) is assembled in a like manner. A front edge of the right upright member of the rear panel 16 is removably attached juxtaposed to a rear edge of the rear upright member of the right side panel 18. These two panels 16, 18 are removably fastened to one another by a threadably fastenable means, such as a male threaded stud 34 which is insertable into and through a bore 36 in the rear panel 16 and further threaded into a female threaded bore 38, as shown in FIG. 3.

The right edge of the front panel 12*a* is removably attached adjacent to a left edge of the front upright member of the right side panel 18. A threadably fastenable means is used to secure these two panels 12*a*, 18 to one another as well. A male threaded stud 40 (not shown) is insertable into and through a bore 42 in the front upright member of the right side panel 18 and further into a mating female threaded bore 44 located the right edge of the front panel 12*a*. The left edge of the front panel 12*a* is attached to the right edge of the front upright member of the left side panel 14 in a similar fashion. The mattress support frame 20 is preferably vertically adjustable to selective heights such as the lower, intermediate and upper levels L,I,U shown. The mattress support frame 20 may be releasably attachable by any suitable means such as a spring biased detent means or the mating male and female threaded members illustrated.

Figure 5:
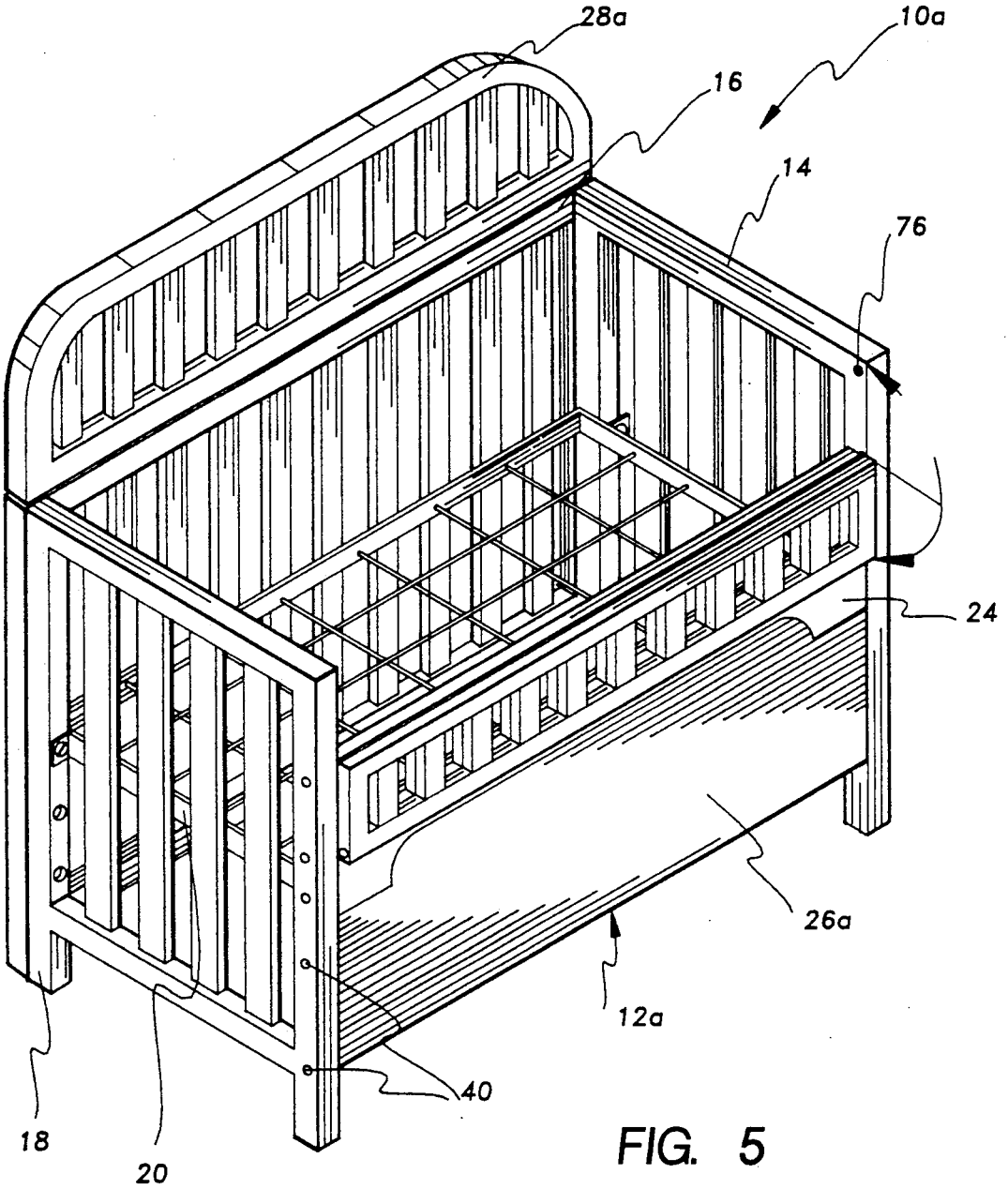
FIG. 5 is a perspective view of the present invention shown in a crib configuration with the crib gate folded down.

Note that the upper gate section 22*a* is shown in FIGS. 3 and 5 includes a substantially planar lower member 46*a* pivotally attached by a hinge element 48 to a substantially planar upper member 50, thus defining a bi-fold gate assembly. The lower member 46*a* is held stationary between the left side panel 14 and the right side panel 18. The upper member 50 is permitted to pivot on the lower member 46*a*, sweeping forward radially 180 degrees about the axis of the hinge element 48, thus providing the open gate position shown.

The gate may be closed and held in a closed position (shown by the broken line) by any suitable latching mechanism, such as a conventional pivotal latch or a spring biased detent means. FIG. 4A shows a left pivotal latch assembly 52 located proximate the upper left forward corner of the crib 10*a*, 10*b*, the right pivotal latch assembly 52 would be a mirror image thereof. This pivotal latch assembly 52 comprises a radially pivotal swing arm 54 which is engagable with a slot 56 defined between a front edge of the front upright member of the left side panel 14 and a fixed receiving member 58. This slot 56 provides a snug fit relationship for the engagement of the swing arm 54 so as to not allow the swing arm 54 to inadvertently disengage.

FIG. 4B shows a left bullet-type detent 60 which may be employed to retain the upper gate section 22*a* in a closed position, the right detent 60 would be a mirror image thereof. This detent 60 includes a bore 62 horizontally disposed within the upper member 50 of the upper gate section 22*a* such that the opening of the bore 62 is exposed through the upper left edge of the upper member 50. A spring 64 is first inserted into the bore 62 and is followed by the insertion of a bullet 66. The bullet 66 passes through a concentric opening 68 in a flat washer 70 which is attached to the upper left edge of the upper member 50 adjacent the opening of the bore 62. A shoulder 72 restricts the passage of the bullet 66, thus allowing the bullet 66 to protrude a predetermined distance through the opening 68 in the washer 70. The protruding tip of the bullet 66 is engagable with a central opening 74 of a disk-shaped member 76.

FIG. 5 is a perspective view of the crib 10*a* shown and described in FIG. 1. This particular view shows the upper gate section 22*a* in its open posture and the mattress support frame 20 elevated to the upper level U.

Figure 6:
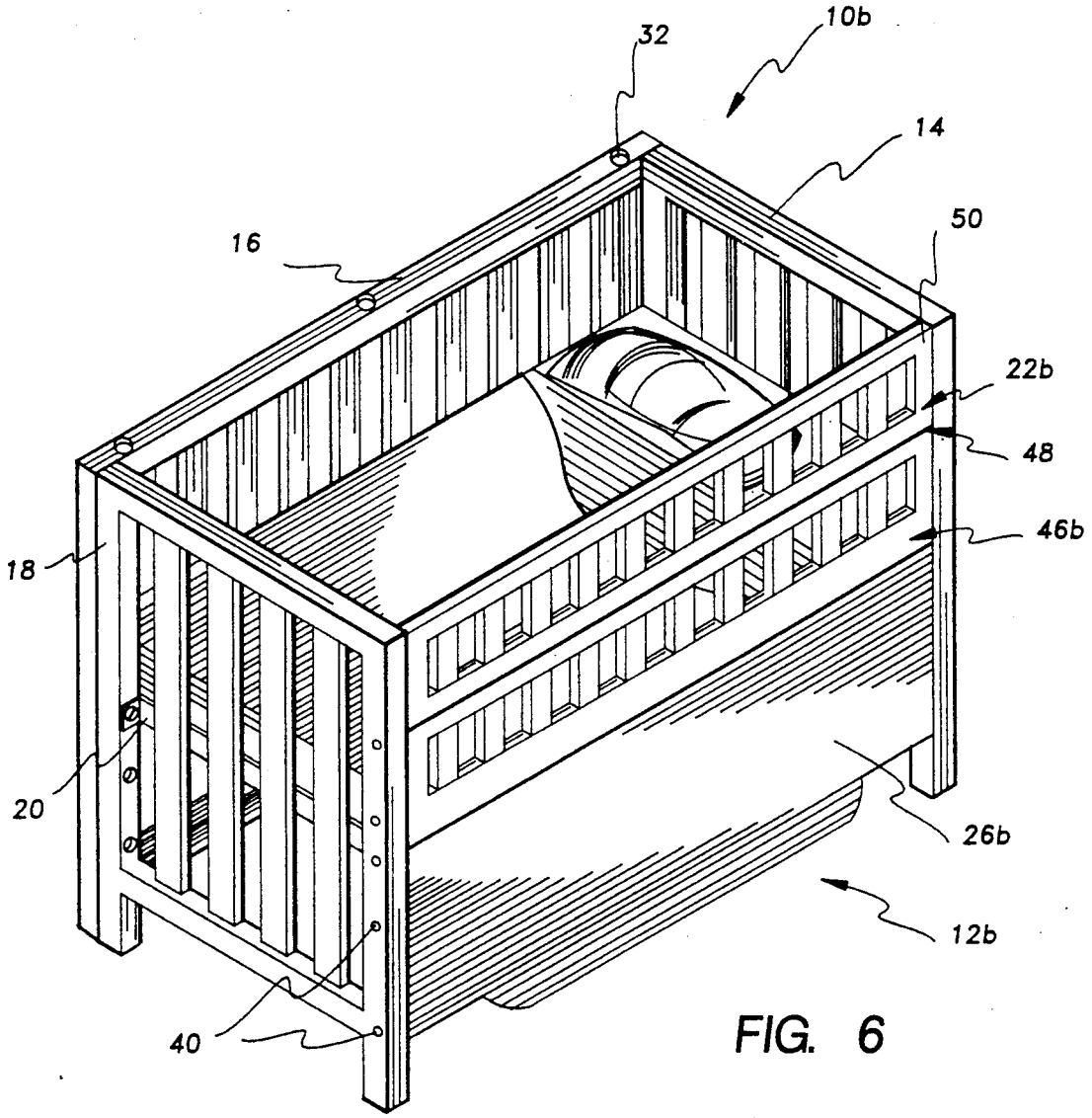
FIG. 6 is a perspective view of the present invention showing an alternative crib configuration.

FIG. 6 shows the crib 10*b* without the intermediate section 24 and without the supplemental panel 28*a*. Again, here the mattress support frame is shown elevated to the upper level P.

Figure 7:
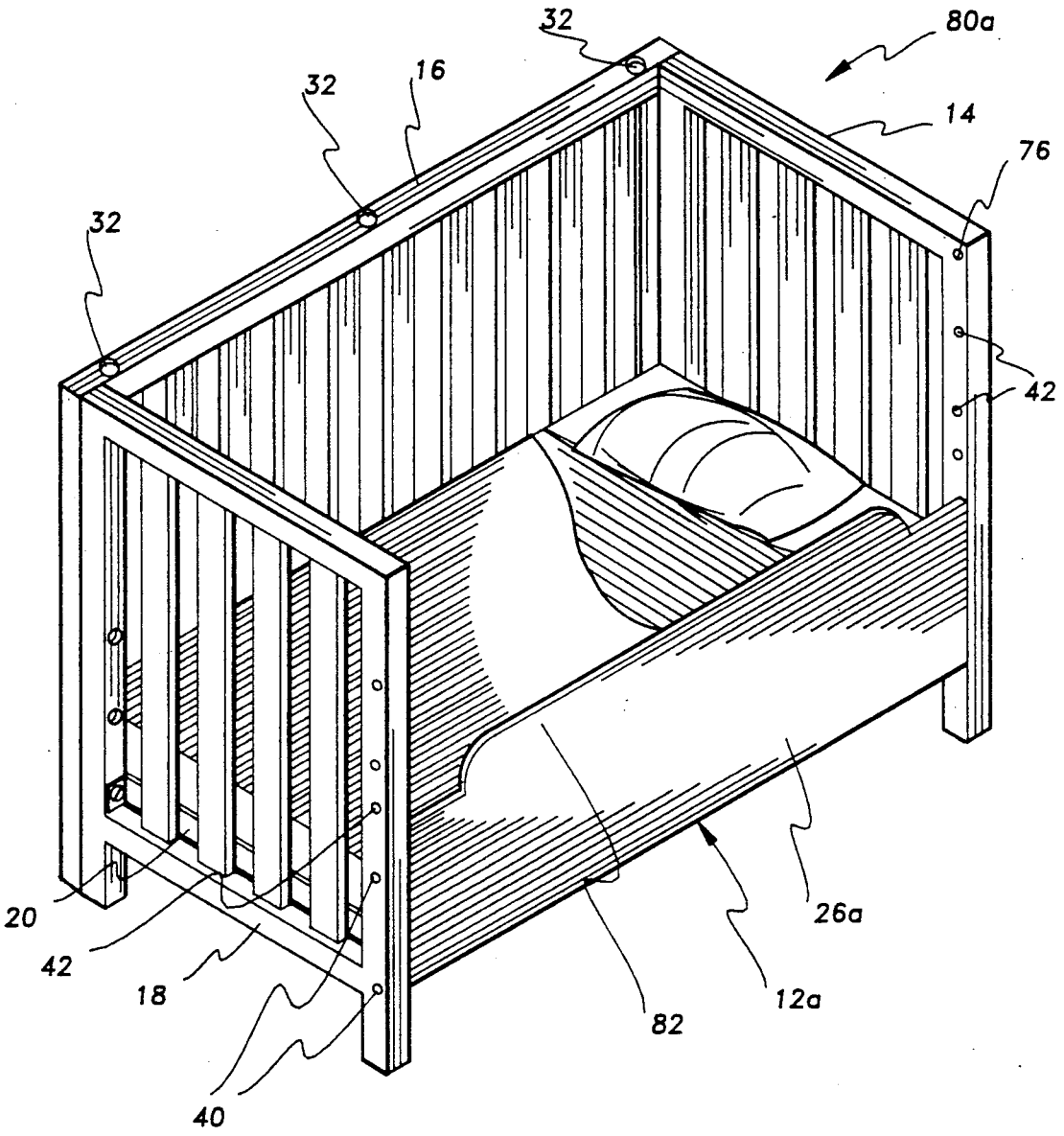
FIG. 7 is a perspective view of the present invention shown in a youth bed configuration wherein the youth bed includes a security barrier.

FIG. 7 shows the crib 10*b* of FIG. 6 converted to a youth bed 80*a*. The crib 10*a* may be converted in a like manner. All of the youth bed 80*a* components are common to the crib 10*b*. The conversion from the crib 10*b* to this youth bed is accomplished simply by removing the upper gate section 22*a* and the intermediate section 24 and lowering the mattress support frame 20 to the appropriate height, preferably to the lower level L. The lower section 26*a* has a vertically projecting longitudinal member 82 centrally disposed between the left and right side panels 14,18. The longitudinal member 82 defines a "roll bar" or a security barrier to prevent a toddler from accidentally rolling off of the edge of the mattress. Note that the ease with which the crib 10*b* is converted to the youth bed 80*a* is made possible merely by the removal of the threaded studs 40. Yet, the remaining portion of the crib 10*b*, that is youth bed 80*a*, is still of a strong, solid construction.

Figure 8:
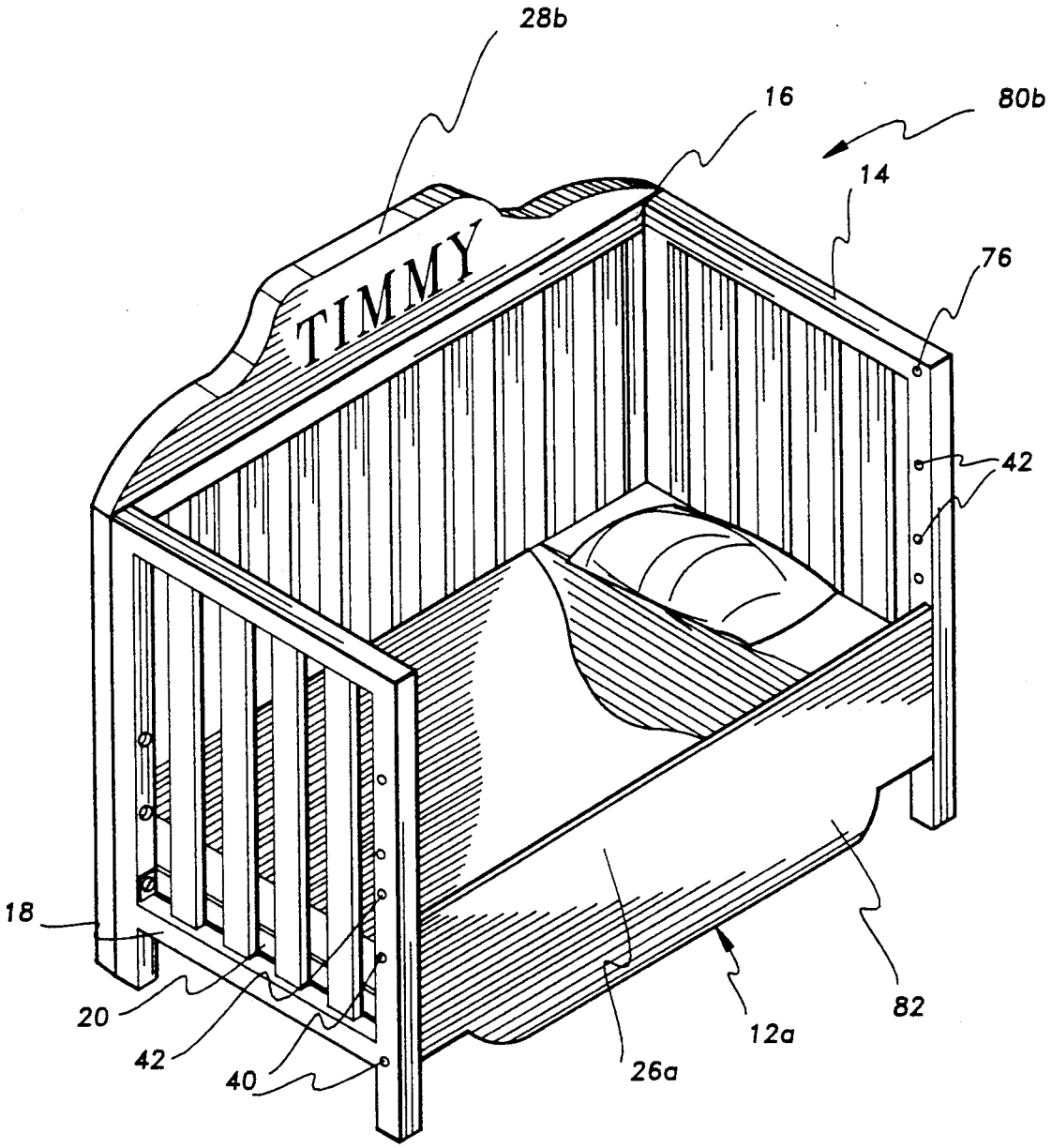
FIG. 8 is a perspective view of the present invention shown in a youth bed configuration wherein the youth bed does not include a security barrier.

FIG. 8 shows a youth bed 80*b* which does not employ the longitudinal member 82 as a roll bar. The conversion from the youth bed 80*a* show in FIG. 7 to this youth bed 80*b* is also very simple The lower section 26*a* of the front panel 12*a* is removed by removing the threaded studs 40 which hold the lower section 26*a* intact With this section 26*a* removed, the remaining portion of the structure remains secure because the mattress support frame 20 is firmly joined to the upright members of both the left and right side panels 14, 18 as well as the rear panel 16. This lower section 26*a* is inverted, so the longitudinal member 82 projects vertically downward The lower section 26*a* is then reattached with the threaded studs 40. An alternative supplement panel 28*b* is shown. This supplemental panel 28*b* may be more aesthetically appealing to a child.

Figure 9:
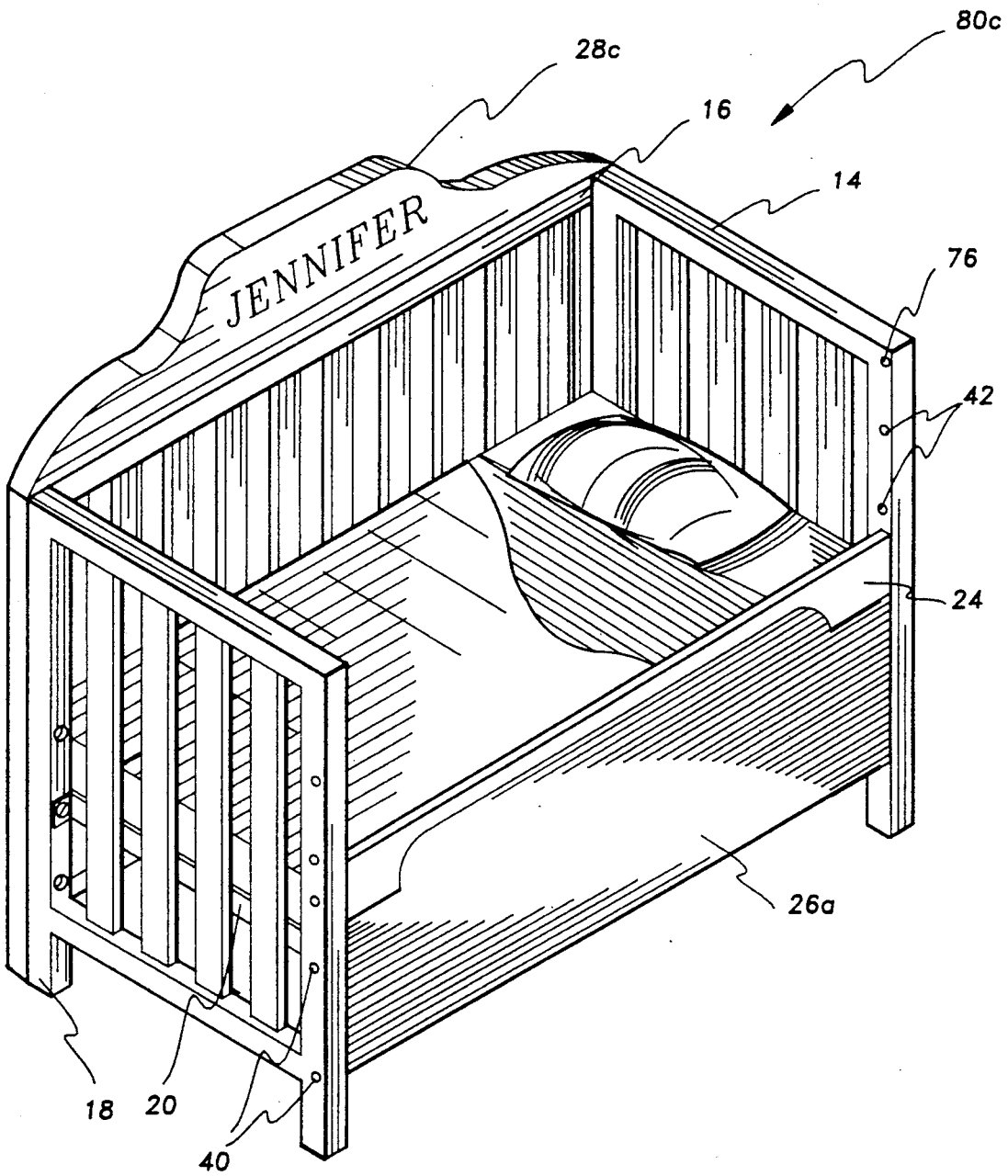
FIG. 9 is a perspective view of the present invention showing an alternative youth bed configuration.

Still, another alternative youth bed 80*c* is illustrated in FIG. 9. Both the intermediate section 24 and the lower section 26*a* are employed in this rendition and the mattress support frame 20 is elevated to the intermediate level L. This youth bed 80*c* configuration may be more suitable for a maturing child than the youth beds 80*a*, 80*b* shows in FIGS. 7 and 8.

Figure 10A:
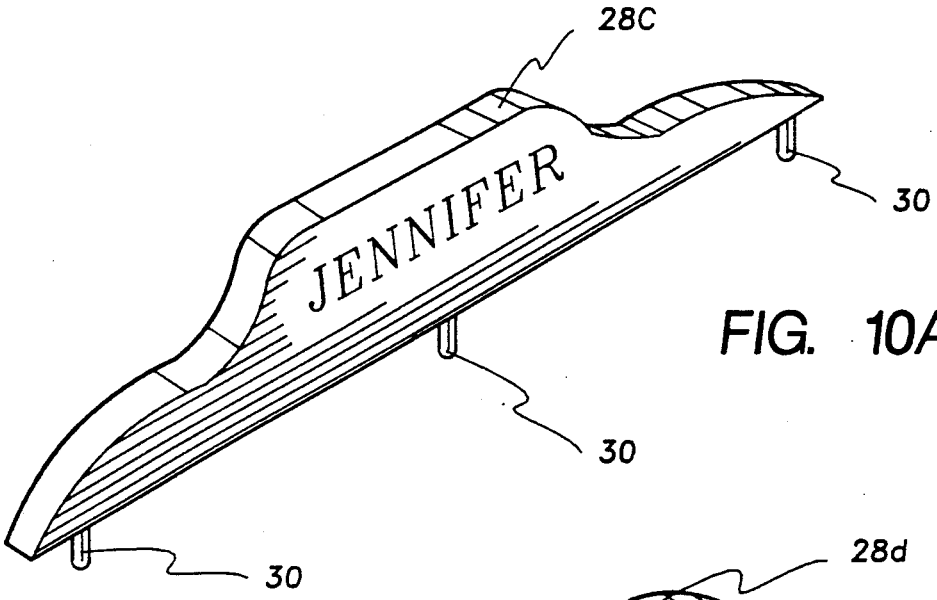
FIG. 10A is a perspective view of a decorative headboard attachment.
Figure 10B:
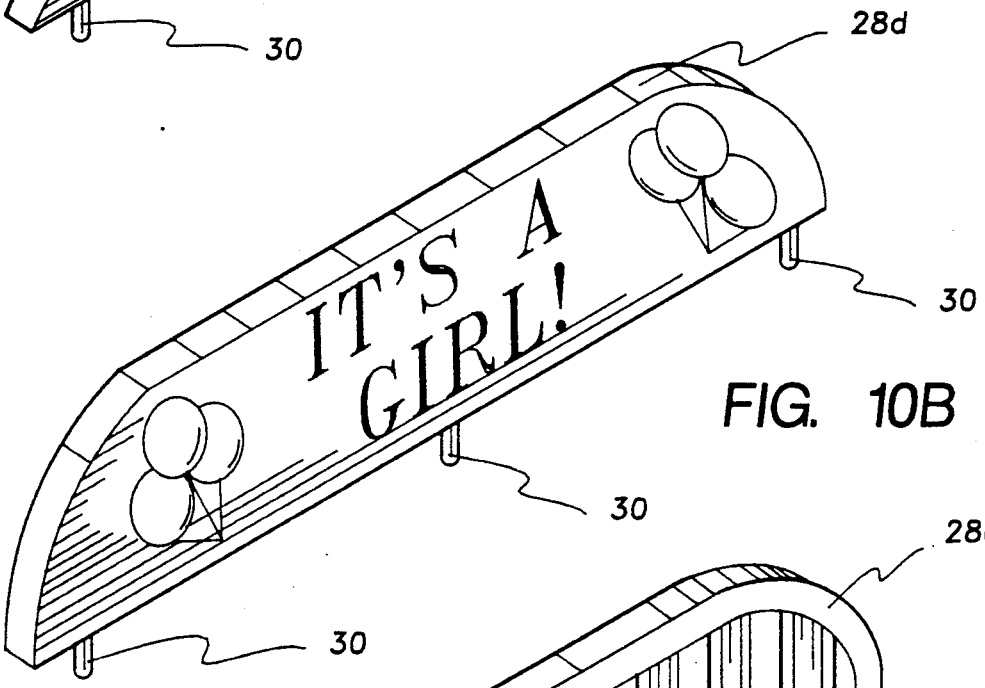
FIG. 10B is a perspective view of an alternative decorative headboard attachment.
Figure 10C:
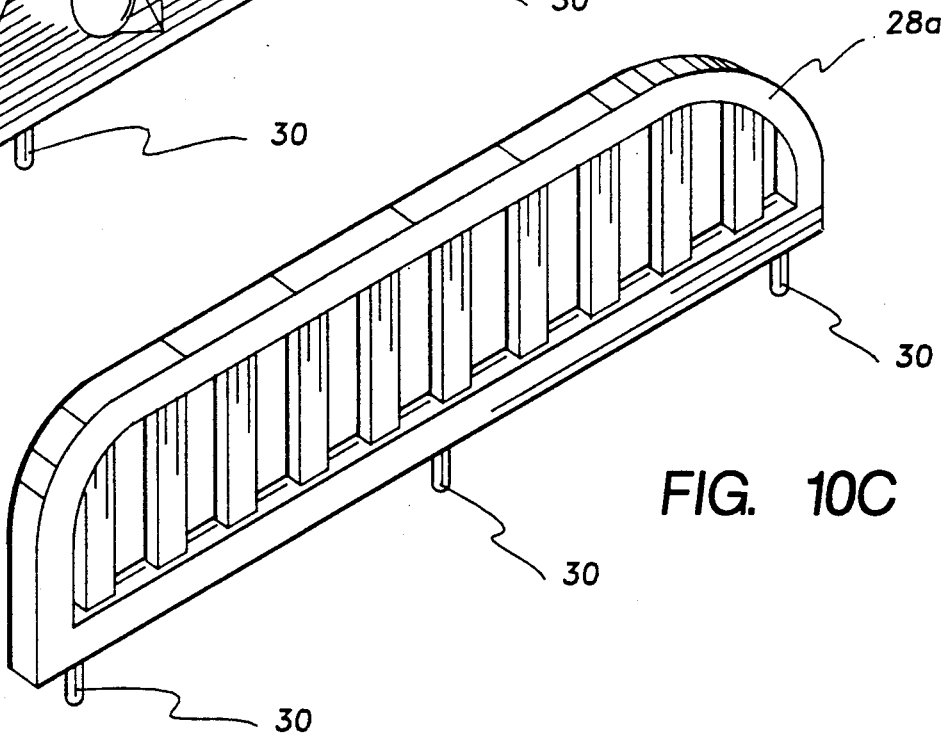
FIG. 10C is a perspective view of another alternative decorative headboard attachment.

FIGS. 10A, 10B and 10C show supplemental panels 28*c*, 28*d*, 28*a* which vary in design. The supplemental panel 28*a* may have an appearance which is coordinated with the appearance of the rear panel 16 or the supplemental panel 28*b*, 28*c*, 28*d* may take on a variety of shapes and may be imprinted with a pattern or indicia, such as a child's name.

Figure 11:
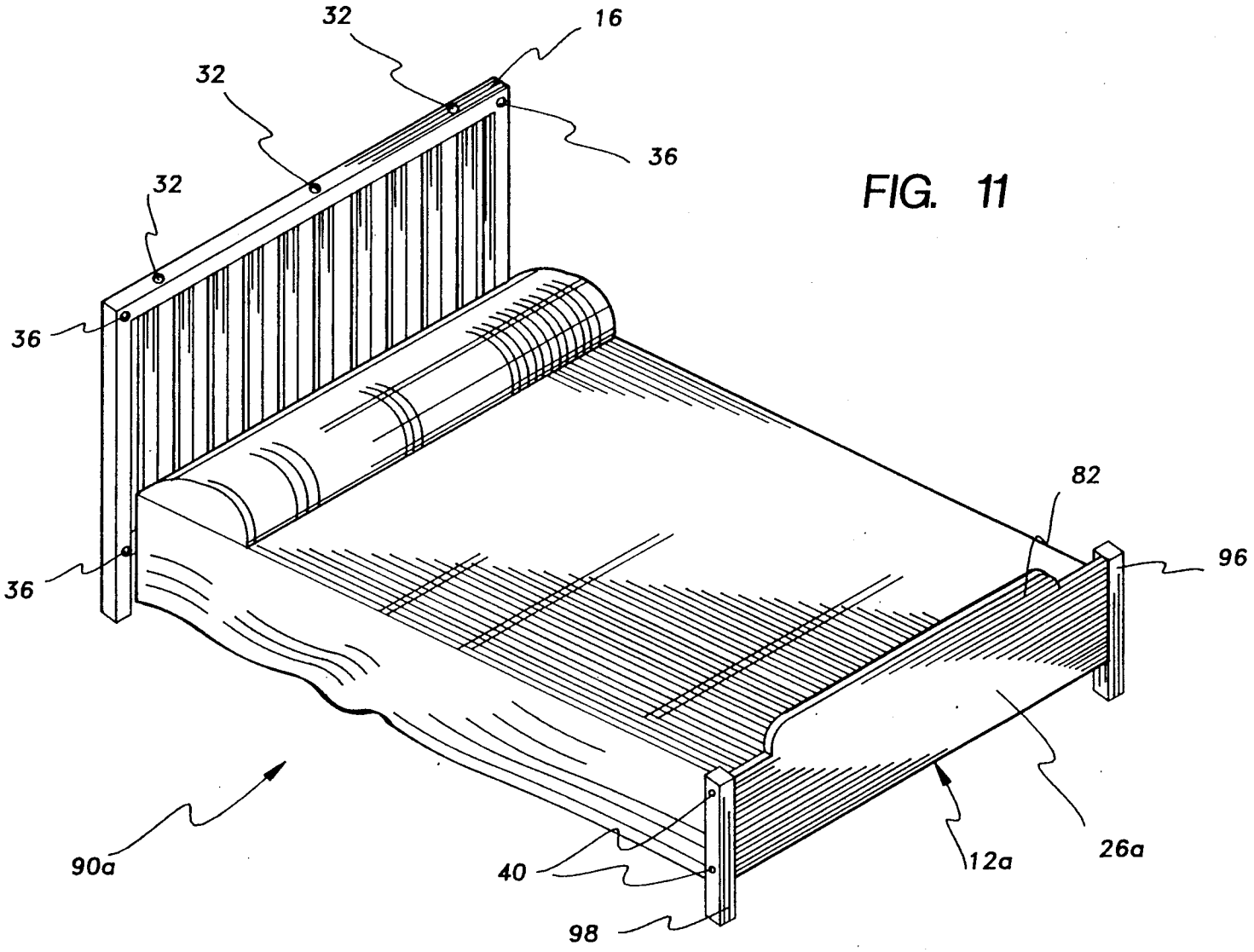
FIG. 11 is an environmental perspective view of the present invention shown in an adult bed configuration.
Figure 12:
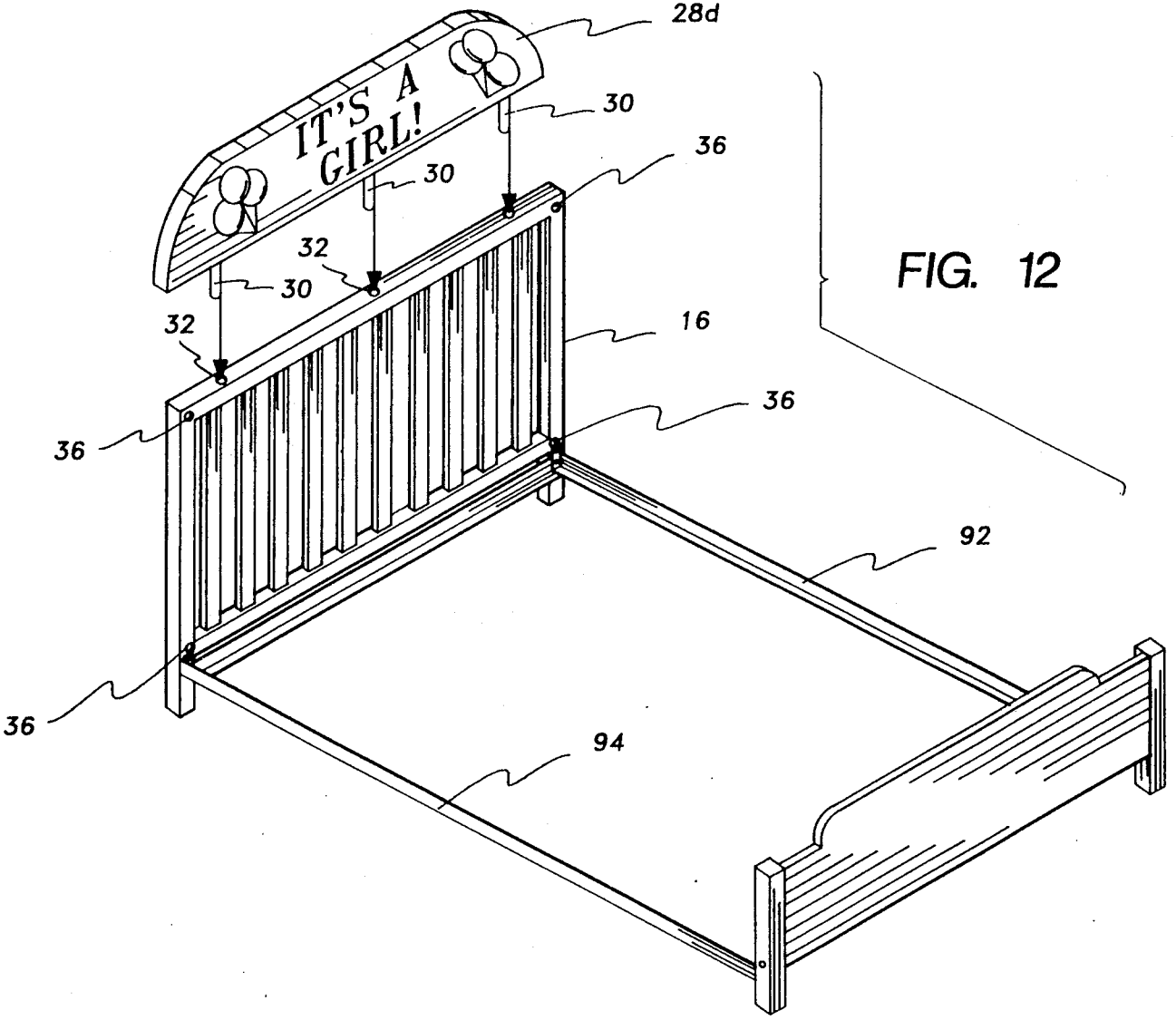
FIG. 12 is a perspective view of the present invention shown in an adult bed configuration.

FIGS. 11 and 12 shows the adult bed 90*a*, 90*b*. Unlike the aforementioned conversions, the adult bed 90*a*, 90*b* requires the addition and elimination of parts. The rear panel 16 is common to all embodiments as is a portion of the front panel 12*a*, namely the lower section 26*a*. These elements 16, 26*a* respectively define the headboard and the footboard of the adult bed 90*a*, 90*b*. However, the left and right side panels 14, 18 as well as the mattress support frame 20 are substituted with independent left and right upright members 96, 98 and left and right bed rails 92, 94. The left and right upright members 96, 98 are respectively attached to the left and right edges of the lower section 26*a* of the front panel 12*a*. The bed rails 92, 94 may be of the conventional type, which includes a flat vertically disposed, downwardly directed hook that is engagable with a slot centrally located and vertically disposed in each of the four upright members, that is the left and right upright members of the rear panel 16 as well as independent upright members 96, 98. The bed rails 92, 94 may also be threadably attachable to the rear panel 16 and the independent upright members 96, 98 in a like manner such as with the mattress support frame 20. The bed rails 92, 94 join the rear side panel 16 to the lower section 26*a* to provide an adult bed 90*a*, 90*b* having a strong, solid construction.

Unused components of this article of furniture are easily stored and each component is designed to occupy a nominal amount of storage space. An article of furniture of this type may be fabricated such that it is a coordinated part of a group of articles. Hence, a single bedroom set could conceivably be used throughout the entire life of an individual.

It is to be understood that the present invention is not limited to the sole embodiment described above, but encompasses any and all embodiments within the scope of the following claims.

I claim:

1. An article of furniture which may be configured to provide a crib, a youth bed, or an adult bed, said article of furniture comprising:

a) a substantially vertical right side panel being essentially planar and having a rear upright member and a front upright member;

b) a substantially vertical left side panel being essentially planar and having a rear upright member and a front upright member;

c) a substantially vertical rear panel being essentially planar and having a right upright member and a left upright member;

d) a substantially vertical front panel including:

1) a substantially vertical lower section being essentially planar and having a top edge, a right edge and a left edge;

2) a substantially vertical intermediate section being essentially planar and having a top edge, a bottom edge, a right edge, and a left edge, said bottom edge of said intermediate section being complementary with said top edge of said lower section; and 3) a substantially vertical upper gate section being essentially planar and having a bottom edge, a right edge, a left edge, and means to releasably retain said gate in a closed posture; and e) a mattress support frame;

f) means to removably attach said front panel, said rear panel, side right side panel and said left side panel to one another, whereby said right side panel and said left side panel are structured and dimensioned to define sides of said crib and are disposed in a spaced apart substantially parallel relation, said rear panel and said front panel are structured and dimensioned to respectively define a back of said crib and a rear and front of said crib and are disposed in a spaced apart substantially parallel relation, said rear panel is extendable from said right side panel to said left said panel such that said right upright member is removably attachable to said rear upright member of said right side panel and said left upright member is removably attachable to said rear upright member of said left side panel, said front panel is extendable between said right side panel and said left side panel such that said right edge is removably attachable to said front upright member of said right side panel and said left side edge is removably attachable to said front upright member of said left side panel, said front panel, said back side panel, said right side panel, and said left side panel are interconnected to form a rectangular structure, and said mattress support is horizontally supported within said rectangular structure to provide said crib, and whereby said upper gate section and said intermediate section of said front panel are removable and said mattress is vertically adjustable to produce a youth bed having a security barrier, and further whereby said lower section of said front panel is removable to produce a youth bed which does not provide a security barrier;

g) an independent front right upright member;

h) a independent front left upright member;

i) a right bed rail having opposing ends; and j) a left bed rail having opposing ends, whereby said mattress support of said youth bed along with said right side panel and said left side panel are removable, said rear panel and said lower section of said front panel are structured and dimensioned to respectively define a headboard and a footboard of said adult bed, said rear panel and said lower section of said front panel are disposed in a spaced apart substantially parallel relation, said left bed rail is extendable between and removably attachable to said left upright member of said rear panel and said independent front left upright member and said right bed rail is extendable between and is removably attachable to said rear right upright member of said rear panel and said independent front right upright member, said rear panel and said lower section of said front panel are interconnected to produce said adult bed.

2. The article of furniture disclosed in claim 1, further including a supplemental panel and a means to attach said supplemental panel coextensively to a top edge of said rear panel in a co-planar relation.

3. The article of furniture disclosed in claim 2, wherein said upper gate section comprises a substantially planar lower member pivotally attached to a substantially planar upper member to provide a bi-fold gate assembly.

4. The article of furniture disclosed in claim 3, further including means to releasably retain said gate in a closed position.

5. The article of furniture disclosed in claim 4, further includes a means to vertically adjust said mattress support frame.

6. The article of furniture disclosed in claim 2, wherein said supplemental panel is reversible to provide at least one ornamental appearance on a front side and a second ornamental appearance on a rear side whereby a user may attach said supplementary panel to said top edge of said rear panel in such a manner that either said front side is directed forward or said rear side is directed forward.

7. The article of furniture disclosed in claim 6, wherein said upper gate section comprises a substantially planar lower member pivotally attached to a substantially planar upper member to provide a bi-fold gate assembly.

8. The article of furniture disclosed in claim 7, further including means to releasably retain said gate in a closed position.

9. The article of furniture disclosed in claim 8, further includes a means to vertically adjust said mattress support frame.

10. The article of furniture disclosed in claim 1, wherein said upper gate section comprises a substantially planar lower member pivotally attached to a substantially planar upper member to provide a bi-fold gate assembly.

11. The article of furniture disclosed in claim 1, further includes a means to vertically adjust said mattress support frame.

12. The article of furniture disclosed in claim 1, further including means to releasably retain said gate in a closed position.

* * * * *